US005775952A

United States Patent [19]

Lu

[11] Patent Number: 5,775,952

[45] Date of Patent: Jul. 7, 1998

[54] PLUG FOR AUTOMOBILE CIGARETTE LIGHTER SOCKET

[76] Inventor: Wen-San Lu, No. 2, Lane 9, June Yi St., Shin Chin Town, Taipei, Taiwan

[21] Appl. No.: 895,207

[22] Filed: Jul. 16, 1997

Related U.S. Application Data

[63] Continuation of Ser. No. 530,622, Sep. 20, 1995, abandoned.

[51] Int. Cl.[6] ..... H01R 17/18

[52] U.S. Cl. ..... 439/668

[58] Field of Search ..... 439/668, 488, 439/490, 622, 621

[56] References Cited

U.S. PATENT DOCUMENTS

| | | | |
|---|---|---|---|
| 5,131,869 | 7/1992 | Wharton | 439/622 |
| 5,201,677 | 4/1993 | Takayama | 439/668 |
| 5,263,879 | 11/1993 | Sasa et al. | 439/668 |
| 5,326,283 | 7/1994 | Chen | 439/622 |
| 5,431,585 | 7/1995 | Fan | 439/668 |
| 5,593,323 | 1/1997 | Dernehl | 439/668 |

FOREIGN PATENT DOCUMENTS 93206908 6/1994 China .

*Primary Examiner*—Gary F. Paumen

*Attorney, Agent, or Firm*—Beveridge, DeGrandi, Weilacher & Young, LLP

[57] ABSTRACT

Disclosed is a plug for an automobile cigarette lighter socket that can be adapted into an automobile cigarette lighter socket of various calibers ranging from 20 mm to 22 mm. The plug can also be secured tightly in position when inserted into the automobile cigarette lighter socket and is easy to manufacture and assemble. The plug comprises a case body having its surface formed with two opposed openings and two opposed elastic pieces positioned symmetrically with respect to the openings; a conducting strip, which is elastic and substantially ring-shaped, with two sides exposing to the outside of the case body through the openings, respectively; and conducting means, connected between the conducting strip and the electrical outlet of the automobile cigarette lighter socket. With the foregoing arrangement, when the plug is inserted into the automobile cigarette lighter socket, the conductive strip and the elastic pieces on the case body in combination exert a pressure on the inner wall of the automobile cigarette lighter socket so as to secure the plug therein. The plug therefore can be adaptively inserted into cigarette lighter sockets of various calibers.

14 Claims, 3 Drawing Sheets

PLUG FOR AUTOMOBILE CIGARETTE LIGHTER SOCKET

This application is a continuation of application Ser. No. 08/530,622, filed Sep. 20, 1995, now abandoned, which application is entirely incorporated herein by reference.

BACKGROUND OF THE INVENTION

1. Field of the Invention

The present invention relates to a plug for an automobile cigarette lighter socket, and more particularly, to the structure of a plug which can be adapted into different types of automobile cigarette lighter sockets for supplying electricity to various electrical appliances for the automobile.

2. Description of Prior Art

Cigarette lighter are a common provision on automobiles for a driver to light his/her cigarette for smoking during driving. Additionally, the socket of the cigarette lighter can be used as an source of electricity to power various electrical appliances on the automobile.

In the present time, there exists various standards for the caliber of plug-type cigarette lighter, which ranges from 20 mm to 22 mm. Therefore, a plug of a fixed size can not be adaptively used on all the cigarette lighter sockets of various calibers. If a plug with a caliber distinct from that of a cigarette lighter socket is forced into a different caliber socket, the mismatch could cause poor contact, voltage change, electrical interference, and adversely effect the battery unit. To solve the compatibility problem, PRC (People's Republic of China) Patent No. 93206908 discloses a plug for an automobile cigarette lighter socket which has its cathode conducting strips formed with various arc shapes so as to fit into cigarette lighter sockets of various calibers. This prior art device provides good electrical contact between the plug and the cigarette lighter socket. However, this prior art device has the drawbacks of its structure being complicated and its four electrical conducting strips being shaped with different curvatures. Such complexity makes manufacturing and assembling of the constituent parts inconvenient. Furthermore, like conventional plugs, the plug is secured in the cigarette lighter socket by means of the elasticity of the electrical conducting strips, which is not a reliable way of securing the plug in position with poor stableness and whereby the electrical conducting strips are apt to cause fatigue deformation. Additionally, the pulling of the cable to remove the plug from the automobile cigarette lighter socket usually loosens the coupling of the constituent parts in the plug. The overall life of use of the plug is therefore shortened.

SUMMARY OF THE INVENTION

It is therefore a primary objective of the present invention to provide a plug for automobile cigarette lighter socket that can be adapted to automobile cigarette lighter socket of various calibers.

It is another objective of the present invention to provide a plug for automobile cigarette lighter socket that can be secured tightly in position when inserted into the automobile cigarette lighter socket.

It is still another objective of the present invention to provide a plug for an automobile cigarette lighter socket that is easy to manufacture and assemble.

It is yet another objective of the present invention to provide a plug for an automobile cigarette lighter socket in which pulling of the cable to remove the plug from the automobile cigarette light socket does not loosen the coupling of constituent parts in the plug.

In accordance with the foregoing and other objectives of the present invention, a novel plug for an automobile cigarette lighter socket is provided. The plug comprises (a) a cylindrical case body formed with two symmetric casing having its surface formed with two opposed openings and two opposed elastic pieces located symmetrically with respect to the openings; (b) a conducting strip, which is elastic and substantially ring-shaped, with two sides exposing to the outside of the case body through the openings, respectively; and (c) conducting means, connected between the conducting strip and the electrical outlet of the automobile cigarette lighter socket.

With the foregoing arrangement, when the plug is inserted into the automobile cigarette lighter socket, the conductive strip and the elastic pieces on the case body in combination exert a pressure on the inner wall of the automobile cigarette lighter socket so as to secure the plug therein. The plug therefore can be adaptively inserted into cigarette lighter sockets of various calibers ranging from 20 mm to 22 mm.

BRIEF DESCRIPTION OF DRAWINGS

The present invention can be more fully understood by reading the subsequent detailed description of the preferred embodiments thereof with reference to the accompanying drawings, wherein.

DETAILED DESCRIPTION OF PREFERRED EMBODIMENT

Figure 1:
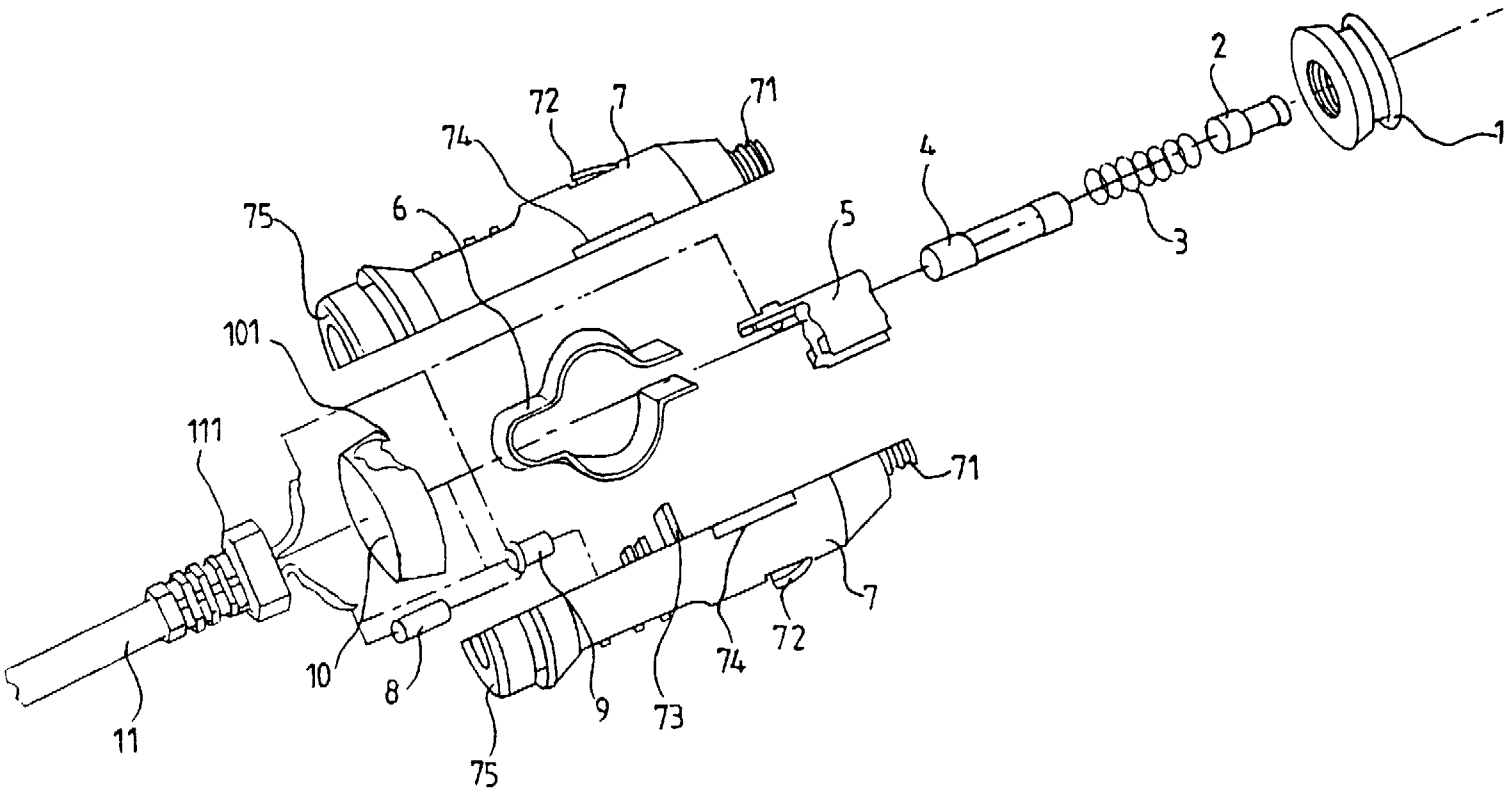
FIG. 1 is an exploded perspective view of a plug for an automobile cigarette lighter socket according to the present invention.

Referring to FIG. 1, the plug for automobile cigarette lighter socket according-to the present invention has a cylindrical case body composed of two symmetric casings 7, each provided with two openings 74 on both edges thereof, respectively, and a elastic piece 72 symmetrically positioned between the two openings 74. When assembled, the two symmetric casing 7 contains a conducting strip 6 which is elastic and substantially ring-shaped with two sides exposed outside of the case body through the openings 74, respectively. Also, the rear end is engaged to the rear of a separator 73. A fuse mount 5, attached to the front of separator 73, is used to mount a fuse 4 which has its front end connected to a spring 3 and a conductive head 2 with its end protruded from a front cover 1. The front cover 1 is formed with a projecting portion around its outer surface for being engaged within the automobile cigarette lighter socket. The front end of each of the symmetric casing 7 is threaded so as to secure the front cover 1.

The securing cap housing 75 formed in the rear end of the symmetric casing 7 is adaptively shaped to accommodate a securing cap 111 which is cast integrally at the terminal of the cable 11. The outer wall of the securing cap housing 75 is formed with an engaging groove. A rear cover 10 can be secured to the securing cap housing 75 by leans of engaging its edge 101 with the engaging groove.

The cable 11 contains two wires, one connected to the fuse mount 5 and the other connected via a resistor 8 and a light-emitting diode (LED) 9 to the conducting strip 6. The LED 9 lights up when electricity flows therethrough and goes off when electricity is interrupted due to, for instance, battery power failure or burn-out of the fuse 4, thus allowing the user to check if the plug conducts electricity normally.

A welded connection is used for connecting the components with each other if necessary during the assembling of the plug. However, a terminal engagement can also be adopted instead of the welded connection.

Figure 2:
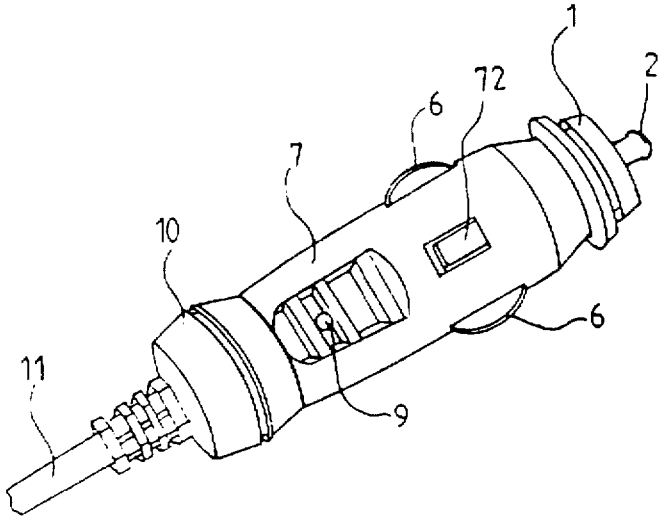
FIG. 2 is a perspective view of the plug of FIG. 1 when it is assembled.

FIG. 2 shows a perspective view of the plug when it is assembled. After being assembled, the conducting strip 6 has its two sides exposed to the outside of the plug through the openings 74 and the rear cover 10 secures the securing cap 111 of the cable 11 within the securing cap housing 75. The cable 11 is connected to an electrical appliance (not shown) within the automobile.

Figure 3:
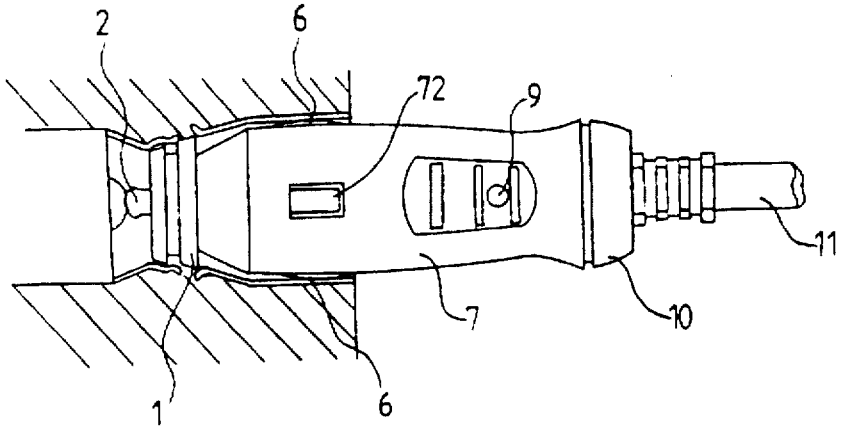
FIG. 3 shows the insertion of the plug of FIG. 1 in an automobile cigarette lighter socket.
Figure 4:
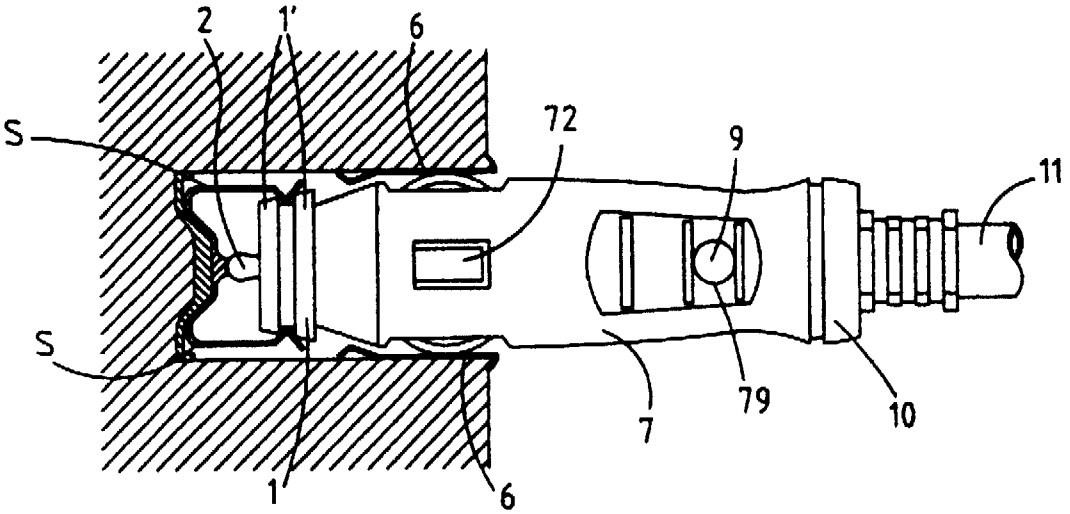
FIGS. 4 and 5 illustrate the inventive plug engaged within known sockets.
Figure 5:
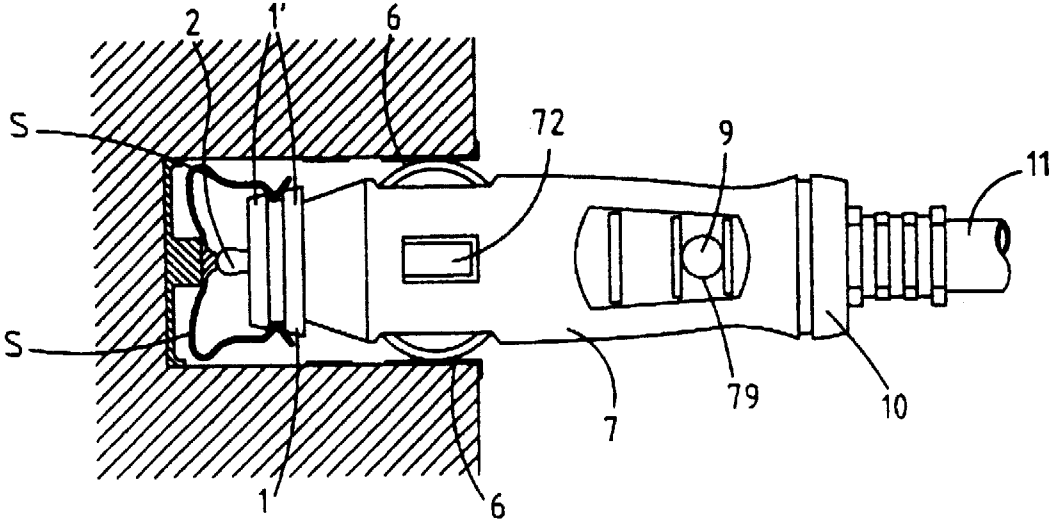

Referring further to FIG. 3, when in use, the plug is inserted into the automobile cigarette lighter socket to allow the conductive head 2 come into electrical contact with the electrical outlet in the cigarette lighter socket, whereby electricity can be transmitted via the conductive head 2, the spring 3, the fuse 4, the conducting strip 6, and onward via the cable 11 to the electrical appliance (not shown). By means of the pressure exerted by the elastic pieces 72 and the exposed sides of the conducting strip 6 against the inner wall of the cigarette lighter socket, the plug can be held tightly in the cigarette lighter socket. Since both the elastic pieces 72 and the exposed sides of the conducting strip 6 are elastically depressible, the plug can be adaptively inserted to cigarette lighter sockets of various calibers, including European, Japanese, and U.S. standards. FIGS. 4 and 5 illustrate the inventive plug engaged within other types of known sockets which include spring members S.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A plug for an automobile cigarette lighter socket, comprising:

a case body having a front end and a rear end, said case body having two openings defined therethrough and said rear end having a securing cap housing provided thereon;

two elastic pieces extending from said case body for engaging an inner periphery of said automobile cigarette lighter socket;

an elastic conducting strip having two sides extending outside of said case body through said openings, respectively;

a first conducting means connected to said conducting strip and contacting an electrical outlet of said automobile cigarette lighter socket;

a cable having a terminal end;

a second conducting means connected to said cable and said connecting strip;

a securing cap engaged with said terminal end of said cable and received within said securing cap housing provided on said case body;

a front cover engaging said front end of said case body, said front cover having an outer surface, a first projecting portion and a second projecting portion, each of said protecting portions being defined about and protecting outwardly from said outer surface of said front cover, said first and said second projecting portions defining a securing recess therebetween, a second securing recess defined between a rear surface of said second projecting portion and said front end of said case body, said first securing recess being for receiving a retaining member of said automobile cigarette lighter socket; and a rear cover engaging said rear end of said case body, wherein, when said plug is engaged in said socket, said elastic pieces deform inwardly and provide clearance for said inner periphery of said socket and apply a holding pressure thereagainst.

2. The plug as claimed in claim 1, wherein said second conducting means includes a resistor and a light-emitting diode (LED).

3. The plug as claimed in claim 1, wherein:

said first conducting means includes a fuse mount, a fuse, a spring, and a conductive head.

4. The plug as claimed in claim 3, further comprising a separator provided within said case body for separating said conducting strip and said fuse mount.

5. The plug as claimed in claim 4, wherein:

said case body is cylindrical, said two openings and said two elastic pieces are alternately and symmetrically positioned on said case body, and said conducting strip is substantially ring-shaped.

6. The plug as claimed in claim 5, wherein:

said first projecting portion has a larger diameter than said second projecting portion, said second projecting portion is disposed further from said two elastic pieces than said first projecting portion, and said second projecting cover has an outer rim portion, said outer rim portion being angled such that a front edge of said outer rim portion has a smaller diameter than a rear edge of said outer rim portion.

7. The plug as claimed in claim 6, wherein:

a retaining member of said automobile cigarette lighter socket is received in said securing recess of said front cover.

8. The plug as claimed in claim 1, wherein:

said first projecting portion of said front cover has a larger diameter than said second projecting portion of said front cover.

9. The plug as claimed in claim 8, wherein:

said second projecting portion is disposed further from said two elastic pieces than said first projecting portion.

10. The plug as claimed in claim 9, wherein:

said second projecting portion has an outer rim portion, said outer rim portion being angled such that a front edge of said outer rim portion has a smaller diameter than a rear edge of said outer rim portion.

11. The plug as claimed in claim 10, wherein:

a retaining member of said automobile cigarette lighter socket is received in said securing recess of said front cover.

12. The plug as claimed in claim 1, wherein:

said first projecting portion has a larger diameter than said second projecting portion, said second projecting portion is disposed further from said two elastic pieces than said first projecting portion, and said second projecting cover has an outer rim portion, said outer rim portion being angled such that a front edge of said outer rim portion has a smaller diameter than a rear edge of said outer rim portion.

13. The plug as claimed in claim 10, wherein:

a retaining member of said automobile cigarette lighter socket is received in said securing recess of said front cover.

14. The plug as claimed in claim 1, wherein:

said first projecting portion has a larger diameter than said second projecting portion, said second projecting portion is disposed further from said two elastic pieces than said first projecting portion, and said second projecting cover has an outer rim portion, said outer rim portion being angled such that a front edge of said outer rim portion has a smaller diameter than a rear edge of said outer rim portion.

* * * * *